US006457659B1

(12) United States Patent
Yang et al.

(10) Patent No.: US 6,457,659 B1
(45) Date of Patent: Oct. 1, 2002

(54) ROLLER PRESS GRINDING PLANT

(75) Inventors: Jian Ling Yang, Singapore (SG); In Young Lee, Singapore (SG)

(73) Assignee: Ssangyong Cement (Singapore) Limited, Jurong (SG)

( * ) Notice: Subject to any disclaimer, the term of this patent is extended or adjusted under 35 U.S.C. 154(b) by 0 days.

(21) Appl. No.: 09/582,236

(22) PCT Filed: Jun. 12, 1998

(86) PCT No.: PCT/SG98/00044

§ 371 (c)(1),
(2), (4) Date: Jul. 24, 2000

(87) PCT Pub. No.: WO99/37404

PCT Pub. Date: Jul. 29, 1999

(30) Foreign Application Priority Data

Jan. 26, 1998 (SG) ..... 9800191-0

(51) Int. Cl.[7] ..... B02C 23/12
(52) U.S. Cl. ..... 241/24.1; 241/79.1; 241/80
(58) Field of Search ..... 241/79.1, 80, 97, 241/152.2, 81, 19, 24.1, 29

(56) References Cited

U.S. PATENT DOCUMENTS 5,505,389 A 4/1996 Süssegger et al.

FOREIGN PATENT DOCUMENTS

AT 51922/93 6/1994

OTHER PUBLICATIONS

3rd party observation filed against corresponding European Patent Office application.

Research Disclosure, No. 387, 1996, p. 427.

Derwent Abstract Accessio N 94–281018/35, EP 614701, Sep. 14, 1994.

Derwent Abstract Accession 97–088123/09, DE 9526040, Jan. 23, 1997.

*Primary Examiner*—Mark Rosenbaum
(74) *Attorney, Agent, or Firm*—Arent Fox Kintner Plotkin & Kahn, PLLC

(57) ABSTRACT

A grinding plant comprising: a high-pressure roller press for crushing raw material into fragments; a static cascade sifter for shifting the fragments from the high-pressure roller press into fine fragments and coarse fragments, the coarse fragments being returned to the high-pressure roller press; and a separator for separating the fine fragments from the static cascade sifter into fine product fragments and less fine reject fragments, at least some of the less fine reject fragments being returned to the static cascade sifter without first pasing through the high-pressure roller press.

13 Claims, 1 Drawing Sheet

ROLLER PRESS GRINDING PLANT

This invention relates to roller press grinding plants.

High-pressure roller presses have been employed for grinding brittle materials for more than 10 years. In the most recent generation of such grinding plants the high pressure roller press operates in closed circuit with a V-separator (static cascade sifter), as developed by KHD Humboldt Wedag AG of Germany. (See, for example, U.S. Pat. No. 5,505,389, the entire contents of which are incorporated herein by reference). These plants have additional benefits in energy saving, robust design and ease of operation for, for instance, finish grinding of cement clinker at product sizes of around 340 $m^2$/kg and granulated blast furnace slag at product sizes of more than 500 $m^2$/kg according to Blaine [EN 196-6:1989 or BS EN 196-6:1992].

The V-separator (static cascade sifter) has a housing with an inlet at the top for material to be filtered and an outlet at the bottom for the coarse fraction of the material. Between the inlet and the outlet runs a channel (sifting zone) defined between a pair of barriers. The sifting zone is inclined to the vertical. The barriers are equipped with cascade-like deflectors which point towards the outlet. The deflectors of one barrier are inclined to those of the other barrier and all the deflectors are inclined to the vertical. Air is forced in a cross-current through the sifting zone, between the deflectors, and towards a second outlet, for fine material, at the top of the housing. When material enters the housing through the inlet it tumbles down the sifting zone under force of gravity, fine particles are blown out of the sifting zone and by the air stream up to the second outlet. The tumbling of the agglomerates in the V-separator causes disagglomeration.

FIG. 1 shows a schematic diagram of one example of such a plant. The feed material to be ground is transported from a bin 1 via endless belt conveyor 2, a bucket elevator 3 and a feeder 4 to the high pressure roller press 5, where the material is pressed under high pressure between the roll gap of the high-pressure roller press. This on one hand causes a disintegration or fragmentation of particles and, on the other hand, produces a cracking on the inside of the particle, leading to a visible formation of agglomerates. The resulting material stream, consisting of fragments of various sizes, flows through a hopper 6 into a V-separator 7 like a cascade over a series of steps through which separation air is routed in a cross-current fashion, as described above. The air removes the fines from the cascading material flow and takes it over a parallel arranged series of ascending separating channels to the fines outlet 9. The coarse fragments, now substantially relieved of the fine material, are transported via a delivery chute 8, a bucket elevator 13 and a return feeder conveyor 14 back to the high pressure roller press where they are re-introduced with the feed material. The fine fraction 9 removed from the V-separator is pneumatically conveyed to a dynamic separator SEPMASTER (trade mark) type SKS separator 10 where fines of desired size 11 and grit rejects 12 are separated. The fines are collected by cyclones and dust collector 15, and are then combined as the finished product 16. The rejects 12 are re-circulated to the roller press.

However, plant of this type has been found to suffer from problems of irregular and unstable roller press operation due to excessive vibration. After analysis, the present applicant has found that this problem is attributable to the feed material of the press. The reject material 12 from the separator 10, which is returned as feed material to the press 5, contains an amount of particles which are sufficiently fine to be output as fines 11 but which are not fully disagglomerated. Depending on the material being processed, up to 40% of the reject material can consist of these agglomerated particles. In extreme cases more of the agglomerated fine particles can be directed as reject material 12 than as fines 11. When the agglomerated fine particles are returned to the roller press there is a large amount of entrapped air which cannot escape when it is pressed, and a fluidisation problem results.

According to a first aspect of the present invention there is provided a grinding plant comprising: a high-pressure roller press for crushing raw material into fragments; a static cascade sifter for sifting the fragments from the high-pressure roller press into fine fragments and coarse fragments, the coarse fragments being returned to the high-pressure roller press; and a separator for separating the fine fragments from the static cascade sifter into fine product fragments and less fine reject fragments, at least some of the less fine reject fragments being returned to the static cascade sifter without first passing through the high-pressure roller press.

The proportion of the less fine reject fragments that is returned to the static cascade sifter can be anything up to 100%, for instance around 20%, around 40%, around 60%, around 80%, around 100%. The remainder (i.e. the less fine reject fragments that are not returned to the static cascade sifter) are preferably returned to the high-pressure roller press.

The grinding plant preferably comprises a conveyor for conveying less fine reject fragments from the separator to the static cascade sifter. The grinding plant preferably comprises a conveyor for conveying less fine reject fragments from the separator to the roller press. The grinding plant preferably comprises a conveyor for conveying the fragments from the roller press to the static cascade sifter. The grinding plant preferably comprising a conveyor for conveying the coarse fragments from the static cascade sifter to the roller press. The grinding plant preferably comprising a conveyor for conveying the fine fragments from the static cascade sifter to the separator. Any of these conveyors may suitably include or be a screw conveyor, a belt conveyor, a delivery chute and/or a bucket elevator.

The static cascade sifter is suitably a V-separator, preferably of the design of the KHD Humboldt Wedag AG V-separator. The static cascade sifter preferably comprises: a feed opening at its top, a first discharge opening at its top for the fine fragments, a second discharge opening at its bottom for the coarse fragments, a pair of barriers between the feed opening and the second discharge opening defining a sifting zone therebetween, the barriers comprising deflectors pointing towards the second discharge opening and the barriers and the sifting zone being oblique to the vertical, and a source of air connected to cause air the flow through the barriers in a cross-current fashion.

The separator is preferably an SKS separator.

The fragments produced by the high-pressure roller press are preferably of various sizes.

It should not be inferred that there is no overlap in size between the fine and coarse fragments and the fine product fragments and the less fine reject fragments. In all practical situations there is likely to be some at least limited overlap. Preferably the fine product fragments are generally smaller in particle size than 90 $\mu$m. Preferably the less fine reject fragments are generally larger in particle size than 90 $\mu$m.

The fragments from the high-pressure roller press may include agglomerated particles, potentially of various sizes.

The said material returned to the roller press is preferably returned to a feed opening of the roller press. The said material returned to the static cascade sifter is preferably returned to a feed opening of the static cascade sifter.

The raw material may include or be cement clinker, blast-furnace slag, limestone and/or a mixture of any or all of those materials, with or without gypsum. Other materials are also suitable. The raw material may be moist. The raw material is preferably brittle.

According to the present invention from a second aspect there is provided a method for grinding raw material, comprising: crushing raw material into fragments using a high-pressure roller press; sifting the fragments from the high-pressure roller press into fine fragments and coarse fragments using a static cascade sifter; returning the coarse fragments to the high-pressure roller press; separating the fine fragments from the static cascade sifter into fine product fragments and less fine reject fragments; and returning at least some of the less fine reject fragments to the static cascade sifter without first passing through the high-pressure roller press.

BRIEF DESCRIPTION OF THE DRAWINGS

The present invention will now be described by way of example with reference to the accompanying drawing, in which FIG. 2 shows a schematic diagram of a grinding plant.

Figure 1:
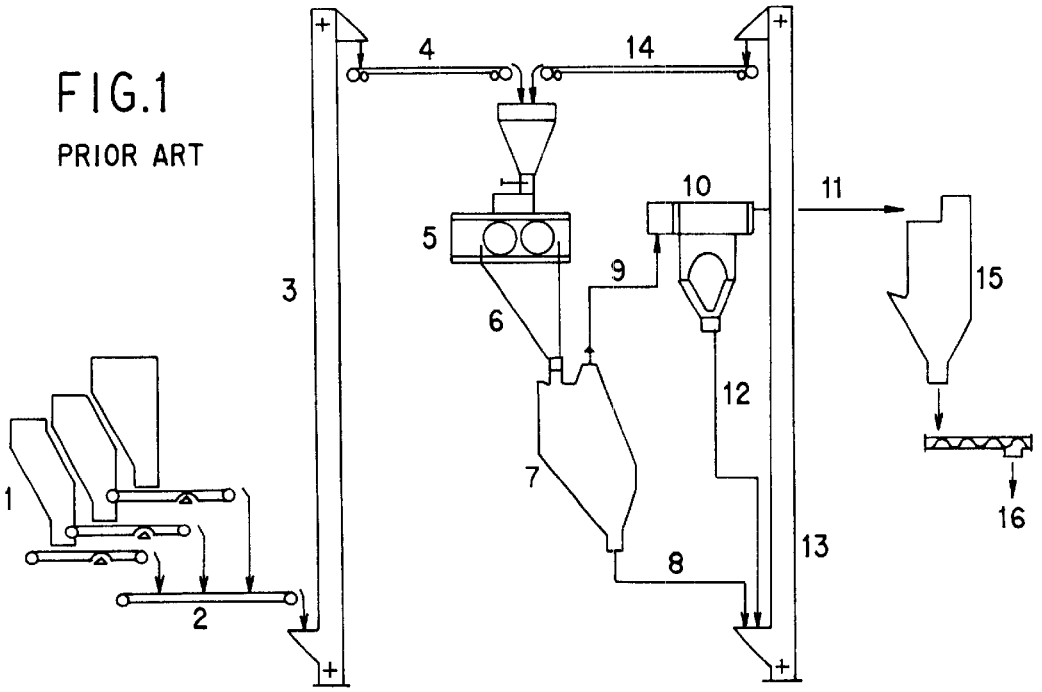
FIG.1 PRIOR ART
FIG. 1 shows a conventional grinding plant.
Figure 2:
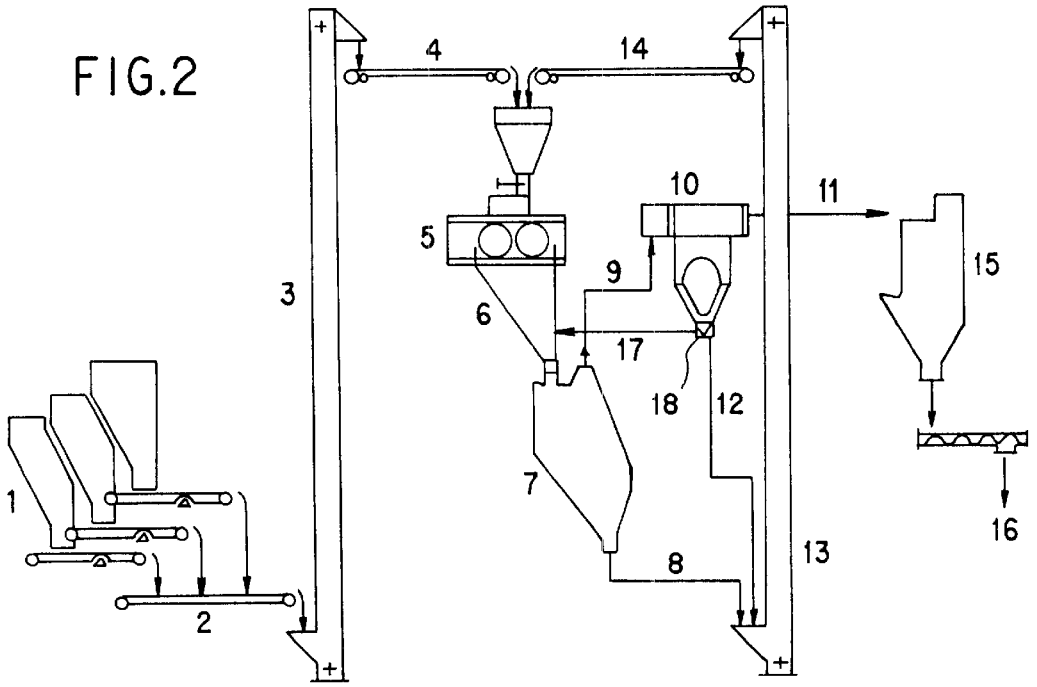
FIG. 2 shows a grinding plant in accordance with this invention.

The plant of FIG. 2 is similar in most respects to that of FIG. 1. Except as described below, like-numbered parts in FIGS. 1 and 2 operate the same and the reader is referred to the description above of the operation of the plant of FIG. 1.

The difference lies in the screw conveyor 17 and the diverter 18. The diverter intercepts the flow of reject fragments 12 from the SKS separator 10. It diverts a proportion of those rejects 12 via conveyor 17 to the hopper 6 at the feed opening of the V-separator 7. As described above, many of the reject fragments may be agglomerated fine particles. As these pass again through the V-separator they are to some extent disagglomerated, so when they return to the separator 10 at least some of them may then be separated at 11 as product from the plant. The others join the rejects at 12 or 17 again.

Screw conveyor 17 could be replaced or supplemented by another conveyor such as a belt conveyor, a bucket elevator or a delivery chute, or a combination thereof.

The diverter 18 is adjustable, suitably even during operation of the plant, to allow the operator to set the proportion of rejects 12 that are to be re-circulated at 17 directly to the V-separator 7 (without first passing through the high-pressure roller press) rather than passing at 12 directly to the roller press. The proportion of the rejects to be diverted at 17 for maximum efficiency depends on the material that is being processed and the details of the plant. The diverter 18 may be set so as to divert some or all of the rejects.

By this improvement it has been found to be possible to increase the output of the present grinding plant by 5% to 25% over that of FIG. 1, depending on the type of materials to be ground. The most outstanding improvements in grinding efficiency can be achieved in the moist grinding of granulated blast-furnace slag, where the reduced re-circulation amount of the rejects from the SKS separator allows a saving in fuel for the hot gas drying step, in addition to the more stable operation of the roller press. In this application the overall power consumption has been found to be reduced by at least 12% and the finished product output increased by at least 20%.

The present invention may include any feature or combination of features disclosed herein either implicitly or explicitly or any generalisation thereof irrespective of whether it relates to the presently claimed invention. In view of the foregoing description it will be evident to a person skilled in the art that various modifications may be made within the scope of the invention. For example, it will be evident that the design of the plant could be adapted for operational reasons.

What is claimed is:

1. A grinding plant comprising:

a high-pressure roller press for crushing raw material into fragments;

a static cascade sifter for sifting the fragments from the high-pressure roller press into fine fragments and coarse fragments, the coarse fragments being returned to the high-pressure roller press; and a separator for separating the fine fragments from the static cascade sifter into fine product fragments and less fine reject fragments, at least some of the less fine reject fragments being returned to the static cascade sifter without first passing through the high-pressure roller press.

2. A grinding plant as claimed in claim 1, wherein the less fine reject fragments that are not returned to the static cascade sifter are returned to the high-pressure roller press.

3. A grinding plant as claimed in claim 1, comprising a conveyor for conveying less fine reject fragments from the separator to the static cascade sifter.

4. A grinding plant as claimed in claim 3, wherein the conveyor is a screw conveyor.

5. A grinding plant as claimed in claim 1, wherein the static cascade sifter comprises:

a feed opening at its top, a first discharge opening at its top for the fine fragments, a second discharge opening at its bottom for the coarse fragments, a pair of barriers between the feed opening and the second discharge opening defining a sifting zone therebetween, the barriers comprising deflectors pointing towards the second discharge opening and the barriers and the sifting zone being oblique to the vertical, and a source of air connected to cause air the flow through the barriers in a cross-current fashion.

6. A grinding plant as claimed in claim 1, wherein the fine product fragments are generally smaller in particle size than 90 $\mu$m and the less fine reject fragments are generally larger in particle size than 90 $\mu$m.

7. A method for grinding raw material, comprising:

crushing raw material into fragments using a high-pressure roller press;

sifting the fragments from the high-pressure roller press into fine fragments and coarse fragments using a static cascade sifter;

returning the coarse fragments to the high-pressure roller press;

separating the fine fragments from the static cascade sifter into fine product fragments and less fine reject fragments; and returning at least some of the less fine reject fragments to the static cascade sifter without first passing through the high-pressure roller press.

8. A method as claimed in claim 7, comprising returning to the high-pressure rolling press the less fine reject fragments that are not returned to the static cascade sifter.

9. A method for improving the efficiency of a grinding plant having a high-pressure roller press for crushing raw material into fragments, a static cascade sifter for sifting the fragments from the high-pressure roller press into fine fragments and coarse fragments, the coarse fragments being returned to the high-pressure roller press, and a separator for separating the fine-fragments from the static cascade sifter into fine product fragments and less fine reject fragments, the method comprising returning at least some of the less fine reject fragments to the static cascade sifter without first passing through the high-pressure roller press.

10. A method as claimed in claim 9, comprising returning to the high-pressure rolling press the less fine reject fragments that are not returned to the static cascade sifter.

11. A method for improving the efficiency of a grinding plant having a high-pressure roller press for crushing raw material into fragments, a static cascade sifter for sifting the fragments from the high-pressure roller press into fine fragments and coarse fragments, the coarse fragments being returned to the high-pressure roller press, and a separator for separating the fine fragments from the static cascade sifter into fine product fragments and less fine reject fragments, the method comprising installing conveying means for returning at least some of the less fine reject fragments to the static cascade sifter without first passing through the high-pressure roller press.

12. A method as claimed in claim 11, further comprising providing as the conveying means a screw conveyor.

13. A method as claimed in claim 11 or 12, further comprising providing as the static cascade sifter a static cascade sifter that comprises:

a feed opening at its top, a first discharge opening at its top for the fine fragments, a second discharge opening at its bottom for the coarse fragments, a pair of barriers between the feed opening and the second discharge opening defining a sifting zone therebetween, the barriers comprising deflectors pointing towards the second discharge opening and the barriers and the sifting zone being oblique to the vertical, and a source of air connected to cause air to flow through the barriers in a cross-current fashion.

* * * * *